US008534267B2

(12) United States Patent
Hassdenteufel et al.

(10) Patent No.: US 8,534,267 B2
(45) Date of Patent: Sep. 17, 2013

(54) DEVICE FOR EXHAUST GAS RECIRCULATION FOR A COMBUSTION ENGINE

(75) Inventors: Klaus Hassdenteufel, Gerlingen (DE); Alexander Fabrizius, Korntal-Muenchingen (DE); Georg Feldhaus, Stuttgart (DE); Michael Schmidt, Bietigheim-Bissingen (DE); Klaus Irmler, Tübingen (DE); Hans-Ulrich Steurer, Stuttgart (DE); Thierry Marimbordes, Bazougers (FR); Pascal Noiseau, Saint Ouen des Toits (FR)

(73) Assignees: Behr GmbH & Co. KG, Stuttgart (DE); Mann + Hummel GmbH, Ludwigsburg (DE)

( * ) Notice: Subject to any disclaimer, the term of this patent is extended or adjusted under 35 U.S.C. 154(b) by 666 days.

(21) Appl. No.: 12/704,374

(22) Filed: Feb. 11, 2010

(65) Prior Publication Data

US 2010/0199650 A1 Aug. 12, 2010

(30) Foreign Application Priority Data

Feb. 12, 2009 (EP) ..... 09290103

(51) Int. Cl.
*F02M 25/07* (2006.01)

(52) U.S. Cl.
USPC ..... 123/568.12; 123/568.17

(58) Field of Classification Search
USPC ..... 123/568.12, 568.17
See application file for complete search history.

(56) References Cited

U.S. PATENT DOCUMENTS

| | | | | |
|---|---|---|---|---|
| 4,134,377 | A * | 1/1979 | Bamsey et al. | 123/568.12 |
| 5,970,960 | A * | 10/1999 | Azuma | 123/568.12 |
| 6,237,336 | B1 | 5/2001 | Feucht et al. | |
| 6,293,265 | B1 * | 9/2001 | Gagnon | 123/568.17 |
| 6,311,677 | B1 * | 11/2001 | Cook et al. | 123/568.12 |
| 6,311,678 | B1 * | 11/2001 | Lepoutre | 123/568.12 |
| 6,513,508 | B2 * | 2/2003 | Fischer et al. | 123/568.17 |
| 7,036,493 | B1 * | 5/2006 | Huebler et al. | 123/568.17 |
| 7,077,114 | B2 * | 7/2006 | Husges | 123/568.12 |
| 7,210,469 | B1 * | 5/2007 | Saele | 123/568.12 |
| 7,607,301 | B2 * | 10/2009 | Harada et al. | 60/605.2 |
| 7,891,345 | B2 * | 2/2011 | Pierpont | 123/568.17 |
| 2002/0112708 | A1 | 8/2002 | Fischer et al. | |
| 2004/0112345 | A1 * | 6/2004 | Bertilsson et al. | 123/568.17 |
| 2006/0278377 | A1 | 12/2006 | Martins et al. | |
| 2007/0044469 | A1 * | 3/2007 | Harada et al. | 60/599 |
| 2007/0271910 | A1 | 11/2007 | Chanfreau | |
| 2008/0087402 | A1 | 4/2008 | Burk | |

FOREIGN PATENT DOCUMENTS

| | | | |
|---|---|---|---|
| DE | 353 11 094 | A1 | 10/1986 |
| DE | 39 16 466 | A1 | 11/1990 |
| EP | 0 881 378 | A2 | 2/1998 |
| EP | 1 152 141 | A1 | 11/2001 |
| EP | 1 882 836 | A1 | 1/2008 |
| EP | 1 911 946 | A2 | 4/2008 |
| FR | 2 856 746 | A1 | 12/2004 |
| FR | 2 879 262 | A1 | 6/2006 |
| JP | 10-89160 | | 4/1998 |
| WO | WO 01/06109 | A1 | 1/2001 |
| WO | WO 03/102396 | A1 | 12/2003 |
| WO | WO2005/001272 | A1 | 1/2005 |
| WO | WO 2005/071240 | A1 | 8/2005 |

* cited by examiner

*Primary Examiner* — Erick Solia
(74) *Attorney, Agent, or Firm* — Muncy, Geissler, Olds & Lowe, PLLC

(57) ABSTRACT

A device for exhaust gas recirculation for a combustion engine is provided that includes an exhaust gas pipe configured to conduct exhaust gas and a channel configured to conduct air to the combustion engine. The exhaust gas pipe terminates in the channel, wherein the exhaust gas pipe, in an area of insertion in the channel exhaust, is in thermal exchange with a coolant from a coolant circuit.

18 Claims, 6 Drawing Sheets

DEVICE FOR EXHAUST GAS RECIRCULATION FOR A COMBUSTION ENGINE

This nonprovisional application claims priority under 35 U.S.C. §119(a) to European Patent Application No. EP 09290103.2 which was filed on Feb. 12, 2009, and which is herein incorporated by reference.

BACKGROUND OF THE INVENTION

1. Field of the Invention

The invention relates to a device for exhaust gas recirculation for a combustion engine.

2. Description of the Background Art

The recirculation of exhaust gas of a combustion engine, for example in order to reduce pollutants, is known for commercial vehicles as well as passenger cars. As demands for low amounts of pollutants are rising, increasing recirculation rates become necessary, e.g. up to more than 30%. Even though measures like exhaust gas coolers are provided, the recirculated exhaust gas can have very high temperatures depending on the recirculation rate and the operating condition. It is known to provide the insertion of the recirculated exhaust gas into a plenum area (intake manifold) formed of metal.

SUMMARY OF THE INVENTION

It is therefore an object of the invention to provide a device for exhaust gas recirculation for a combustion engine, by which a large stream of hot exhaust gas can be inserted into the combustion air in a simple manner.

By means of a thermal exchange with a coolant, an overheating of the insertion area of the exhaust gas into the air-ducting channel is avoided. Thereby, surrounding parts can be laid out less critical and a higher safety for cases of extreme operating conditions and in cases of malfunction, e.g. of exhaust gas coolers or an exhaust gas control, is achieved. A coolant in the sense of the invention can be understood as any suitable fluid circuit of the combustion engine or even of a vehicle in general, like for instance the engine-coolant circuit, a separate low-temperature circuit or even the refrigeration circuit of an air conditioning system. The coolant can be a liquid, but can also be gaseous or be present in multiple phases.

In an embodiment of the invention, the exhaust gas pipe can be connectable to an assembly member, which can be formed of metal, wherein the coolant flows through a coolant channel provided at the assembly member. Thereby the assembly member can be cooled, thus making it possible to provide the assembly member at structures which are not heat-resistant. Examples for such structures are, for example, an air-conducting channel made from plastics or even a charge air cooler made from aluminum. Examples of an assembly member can be a plate, a formed sheet metal part, a part formed by milling or any other suitable part, in particular made from Aluminum or from steel, which is laid out, on the one hand, to receive the exhaust gas pipe and, on the other hand, to be fixed to the air-ducting channel. The respective way of fixing is at will according to the respective demands, e.g. by bonding (soldering, welding, gluing etc.), using fixation means like screws, nails, bolts, clips etc. or in any other way.

For the purpose of simple fixing, in an embodiment, the exhaust gas pipe has a flange which can be connected to the assembly member. Thereby, a particularly detachable connection, e.g. by means of screwing down of the flange, is possible. In this respect, it may be provided in a further embodiment that the coolant channel also flows around the screws or a fixation component, as these constitute heat bridges. Further, a seal can be arranged between the flange and the assembly member. Thereby, not only providing a sealing between the exhaust gas pipe and outside area, but also as an additional insulation against a heat transfer from the hot exhaust gas pipe to the assembly member. The coolant channel can be arranged on a side of the assembly member which is opposite to flange, but may even be arranged on the same side according to respective demands.

In another embodiment of the invention, the coolant channel is provided as a tube which is connectable to the assembly member, for example, by bonding. Such tube may have a cornered or round cross section. The connection of the coolant channel with a cooling circuit may then, for instance, take place by simple plugging of hoses onto free ends of the tube.

In an another embodiment, the coolant channel may also be provided as a sheet metal part, either one-piece or multipart, which is connectable with the assembly member, for example, by bonding.

In an embodiment of the invention, the insertion area of the exhaust gas pipe can be provided at a charge air cooler which is passed through by the coolant. Thereby the exhaust gas can enter the charged air in the region of the cooler, hence a good swirling and, simultaneously, a further cooling of the exhaust gas, or rather a better use of the charge air cooler, being achieved. In an embodiment, in order to simplify the construction, the insertion area can be provided at a coolant-sided header member of the charge air cooler. With a suitable design of the header member, a sufficient cooling of the insertion area can already be achieved in this way by means of the coolant streams in the header. According to the respective demands, an additional coolant pipe may also be provided for the cooling of the exhaust gas pipe.

In another embodiment, the exhaust gas pipe enters into the channel upstream of a charge air cooler. Particularly in this region, conventional air-ducting channels are made from plastics in order to save costs and weight, which has been opposing to an insertion of hot exhaust gas up to now. Generally it is further advantageous, that with an insertion upstream of the charge air cooler, an optimum mixing and further cooling of the mixture of exhaust gas and charged air within the charge air cooler results.

Generally, in order to save costs and weight, it is provided and made possible by the invention that the channel can be made of plastics at least in a region of insertion of the exhaust gas pipe.

By way of designing the exhaust gas pipe in a region of its insertion into the channel as at least one tube section, the tube section having a plurality of outlet openings for the exhaust gas along the tube section, a distribution of the exhaust gas stream into multiple partial streams over a large area of space is achieved. Thereby, an excessive local heating, e.g. of a wall of the channel, is avoided and furthermore the mixing of exhaust gas and air is improved.

In an embodiment, the exhaust gas pipe branches into a number of tube sections in the region of its insertion, a particularly homogenous distribution of the exhaust gas is thereby achieved. On the other hand, only a single tube section for the injection of the exhaust gas into the air can be provided on behalf of a simple construction.

In another embodiment of the invention, the outlet openings can be, with respect to number and/or size, distributed alongside the tube section in a way that a hydraulic outflow width per length of the tube section increases in the flow direction of the exhaust gas. Thereby a pressure decrease over the length of the tube section is taken into account, the emerging mass flow of the exhaust gas being distributable according to the demands, and in particular homogenously, over the length of the tube section.

As a supplementary or alternative measure, flow obstacles are arranged at at least some of the outlet openings, a swirl being achievable and/or a preferred outflow direction being provided. Thereby, a harmful heat transfer, e.g. into the walls of the channel, can be further avoided.

For optimizing the distribution of the exhaust gas in the air stream which is flowing through the channel, and hence for the purpose of homogenizing the temperature or avoiding of temperature peaks, it may be provided that the outlet openings are, at least predominantly, aligned at an outlet angle of between 45° and 135°, in particular between 90° and 135°, with respect to a main flow direction of the air in the channel.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
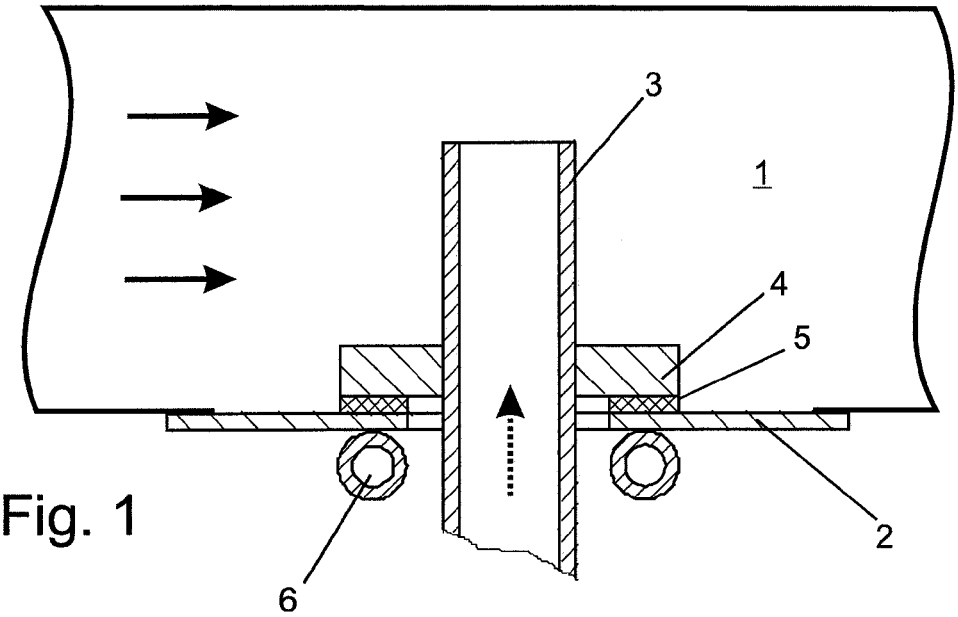
FIG. 1 shows a cross section through a first exemplary embodiment of the invention.
Figure 2:
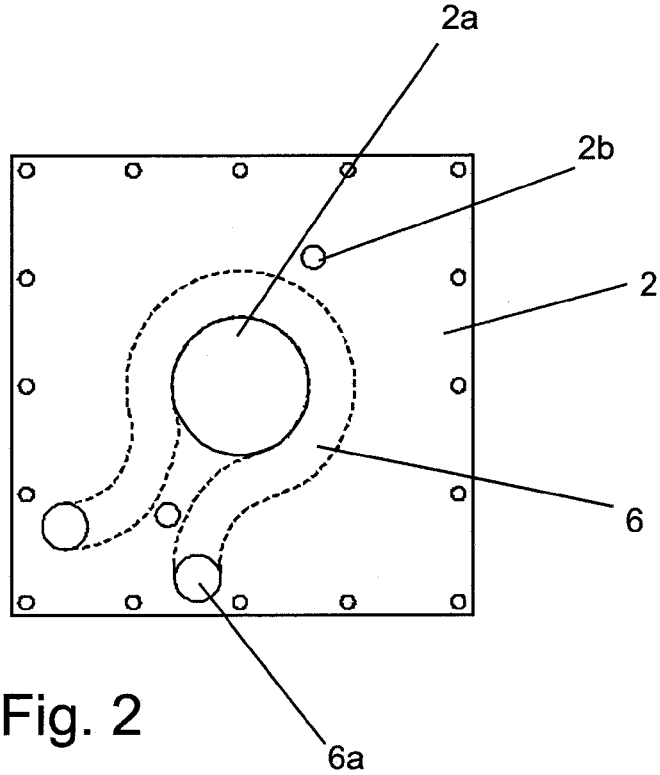
FIG. 2 shows a plain view of an assembly member of the example of FIG. 1.
Figure 3:
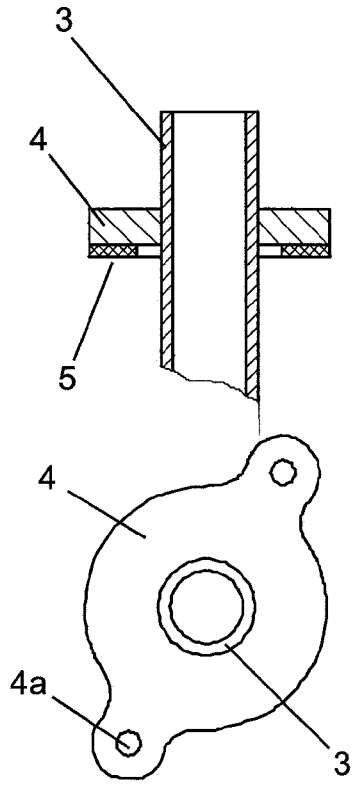
FIG. 3 shows a lateral and surfacing plain view of an exhaust gas pipe of the example of FIG. 1.

A device for recirculation of exhaust gas according to a first embodiment of the invention (FIG. 1) comprises an assembly member 2 that is formed as an open-worked aluminum plate, the assembly member is fixed above a lateral opening of a channel 1 which is conducting compressed combustion air. The fixation at the channel may be established at will, e.g. by means of gluing, positive fitting and/or screwing.

The assembly member has a central opening 2*a*, an exhaust gas pipe 3 made from a temperature-resistant material, such as stainless steel, being inserted in the opening such that the exhaust gas (dashed arrow) flows into the channel in order to mix with the combustion air (solid arrows). The position of the injection into the channel 1 is located upstream of a charge air cooler.

A flange 4 is provided on the exhaust gas pipe 3, the assembly member 2 and the exhaust gas pipe 3 being connected to each other in a sealed manner by means of the flange. For this purpose, a seal 5 is located between flange 4 and assembly member 2. The flange 4 can be detachably fixed by, for example, screws (not shown) which protrude through corresponding screw apertures 4*a*, 2*b* of the flange and the assembly member.

A coolant channel 6, which substantially or partially surrounds the central opening 2*a*, is provided at the assembly member in order to cool it. The coolant channel 6 is located at an opposite side of the flange 4 and is configured as a round tube. The coolant channel 6, can be, for example, made from aluminum and can be soldered to the plate 2 in aerial contact. Its connection (not shown) to a cooling circuit may be provided by simple plugging of hoses onto its ends 6*a*. The cooling circuit may, for instance, be the cooling circuit of the combustion engine or even a separate or connected low-temperature-circuit.

It is obvious from the drawings that the coolant channel 6 can be entirely arranged at the assembly member 2. This is true for all of the embodiments with a coolant channel 6 described hereinafter. In this respect, no gasket is provided between the coolant channel on one side and channels for air and/or exhaust gas on the other side, which makes a hazardous break-in of coolant into the combustion gas of the engine impossible because the coolant channel 6 is completely separated from the channel and the exhaust pipe.

The invention works as follows:

During operation of the combustion engine, an adjustable portion of the exhaust gas is branched off and, if applicable after cooling in an exhaust gas cooler (not shown), is fed into the compressed combustion air in the channel 1 through the exhaust gas pipe 3. In doing so, the exhaust gas pipe can heat up to a high temperature of several hundred ° C. A damaging of the material of the channel 1 is avoided by the fact that the exhaust gas pipe, in the region of its insertion, transfers heat to the coolant in the coolant channel 6, the assembly member 2 at any time having an uncritical temperature at least in the region of its contact with the channel 1. By means of the seal 5, an additional insulation between assembly member 2 and exhaust gas pipe 3 is provided.

Figure 4:
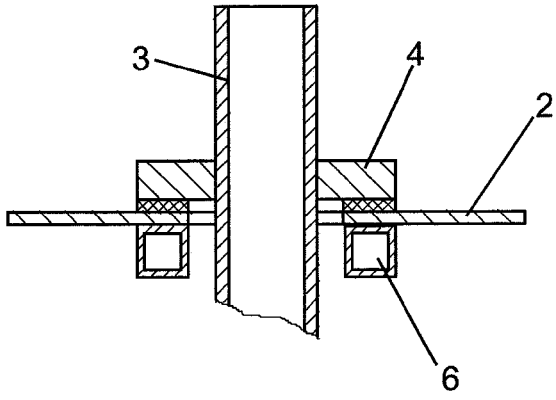
FIG. 4 shows a sectional view of a second embodiment of the invention.

Second Embodiment (FIG. 4)

As distinguished from the embodiment of FIG. 1, the tube of the coolant channel 6 can have a rectangular cross section, a particularly large contact area between coolant channel 6 and assembly member 2 being thereby available.

Figure 5:
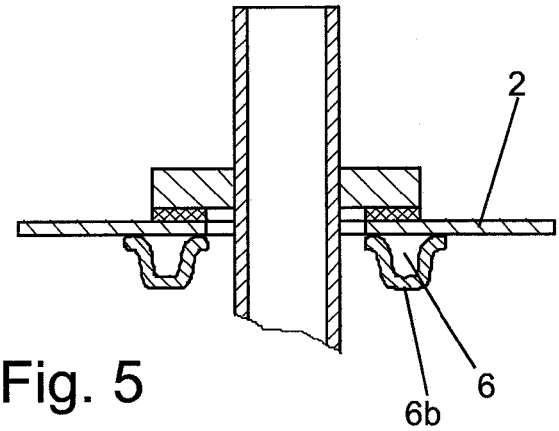
FIG. 5 shows a sectional view of a third embodiment of the invention.

Third Embodiment (FIG. 5)

As distinguished from the first two embodiments, the coolant channel 6 now is built from a formed sheet metal part 6*b* which is open towards the assembly member, the assembly member 2 forming a part of the wall of the coolant channel 6.

The formed part 6*b* is connected to the assembly member 6 in aerial contact, whereby for instance at least one of the parts may be formed from a sheet cladded with brazing material.

Figure 6:
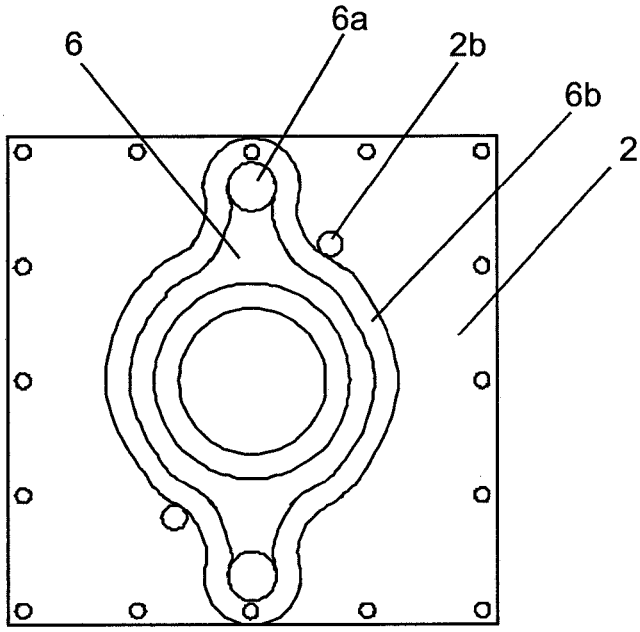
FIG. 6 shows a plain view of the example of FIG. 5.

FIG. 6 shows, in an exemplary way, the course which the formed sheet metal part 6*b* may provide for the coolant channel 6. Furthermore, ports 6*a* for the coolant circuit are arranged at the formed sheet metal part 6*b*.

Figure 7:
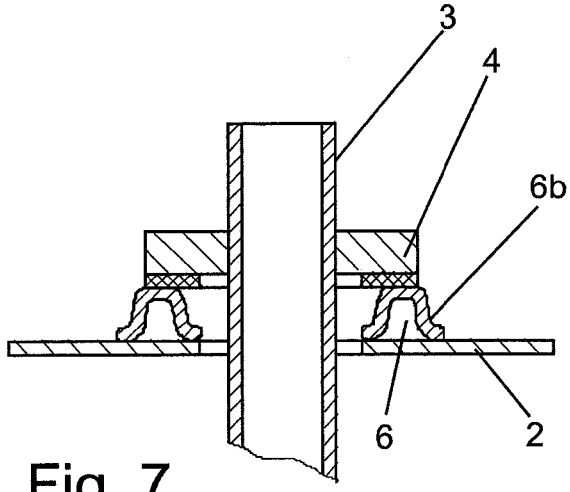
FIG. 7 shows a sectional view of a fourth embodiment of the invention.
Figure 7A:
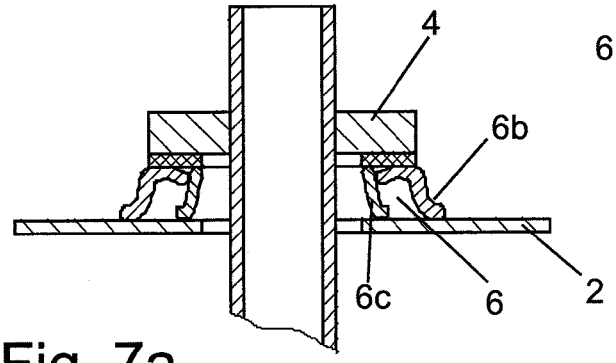
FIG. 7*a* shows a variation of the fourth embodiment.

Fourth Embodiment (FIG. 7, FIG. 7*a*)

As distinguished from the third embodiment, coolant channel 6 and flange 4 are located on the same side of the assembly member 2. In this case, the flange 4 sits, with its seal 5, directly on the formed metal sheet part 6*b*, a particularly good and actively cooled insulation between flange 4 and assembly member 2 being provided. In FIG. 7*a* the possibility is shown that the formed metal sheet part may well be constructed from several segments 6*b*, 6*c*.

Figure 8:
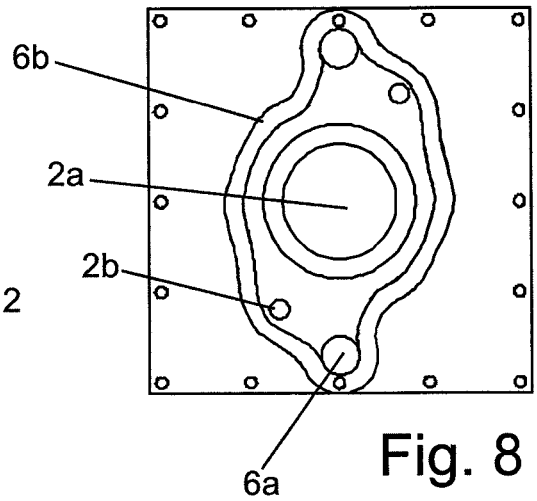
FIG. 8 shows a plain view of a fifth embodiment of the invention.

Fifth Embodiment (FIG. 8)

As distinguished from the third embodiment (see FIG. 6, for instance), here the coolant channel is formed such that it also envelopes the fixation screws 2*b*. Thereby, also these heat bridges are actively cooled.

Figure 9:
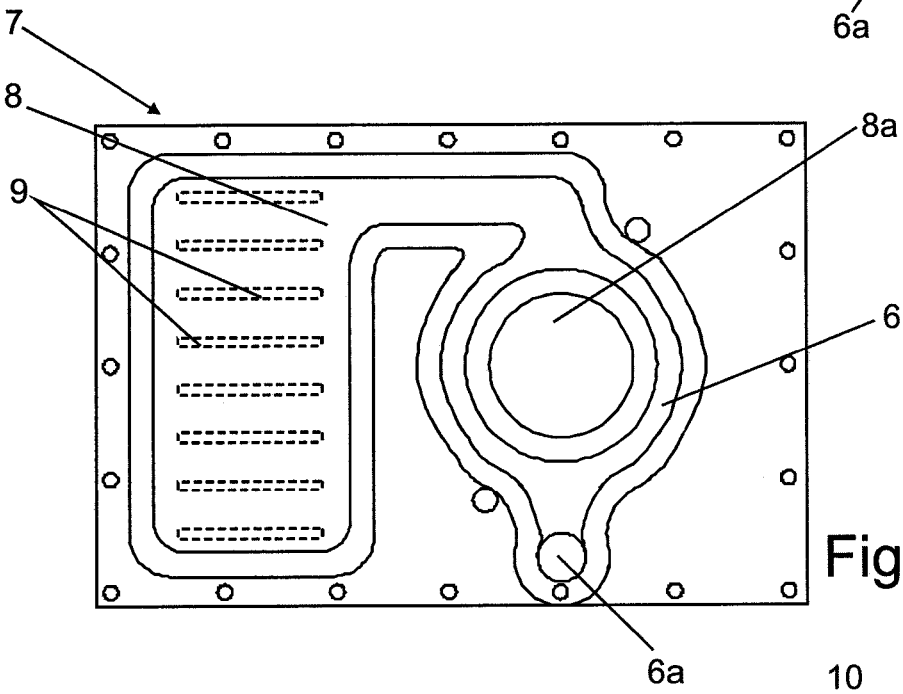
FIG. 9 shows a plain view of a sixth embodiment of the invention.
Figure 10:
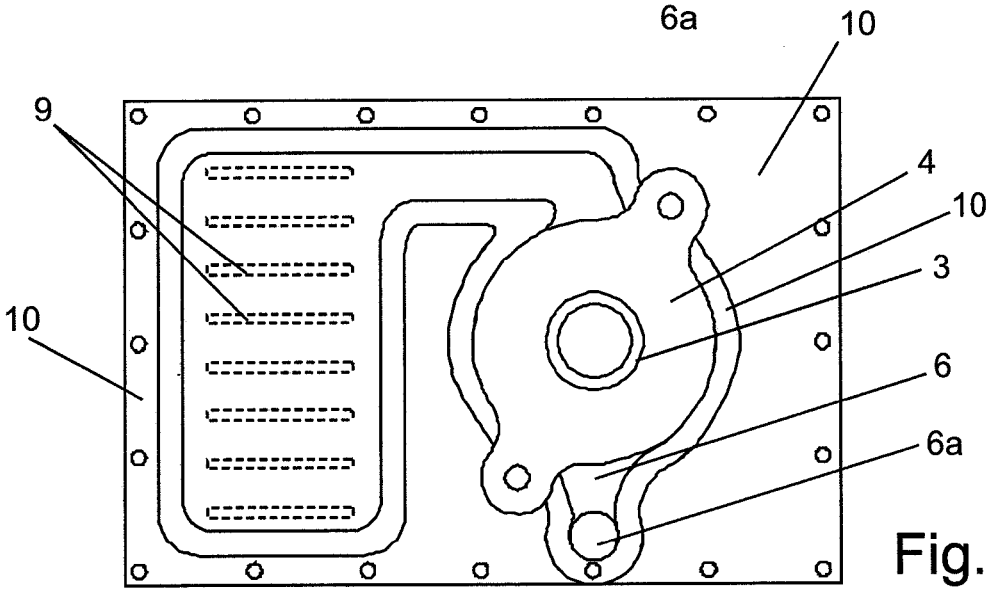
FIG. 10 shows the embodiment of FIG. 9 with inserted exhaust gas pipe.

Sixth Embodiment (FIG. 9, FIG. 10)

In the sixth embodiment, the device according to the invention is provided as a structural unit with an indirect and/or coolant-operated charge air cooler 7, which has flat tubes 9, the tubes being circulated around by air and passed through by coolant, the charge air cooler being in close proximity to the exhaust gas pipe. In this case, a bottom 8 of the charge air cooler 7 is enlarged or designed in such way that it comprises an opening 8*a* for the exhaust gas pipe 3. Additionally, a header cap 10 or water tank of the charge air cooler is formed correspondingly. It may be provided to combine the header cap 10 or water tank of the charge air cooler and a coolant channel 6 in a formed sheet metal part, which for instance may be deep drawn. According to the respective form, a coolant channel 6 is not necessarily provided in the case of this embodiment, as an active cooling of the exhaust gas pipe 3 is already provided because of the feeding through the header. Anyway, a coolant channel 6 with a port 6*a* is noticeably formed in the present drawings FIG. 9, FIG. 10, the port 6*a* simultaneously being a connection of the charge air cooler with the coolant circuit.

Figure 11:
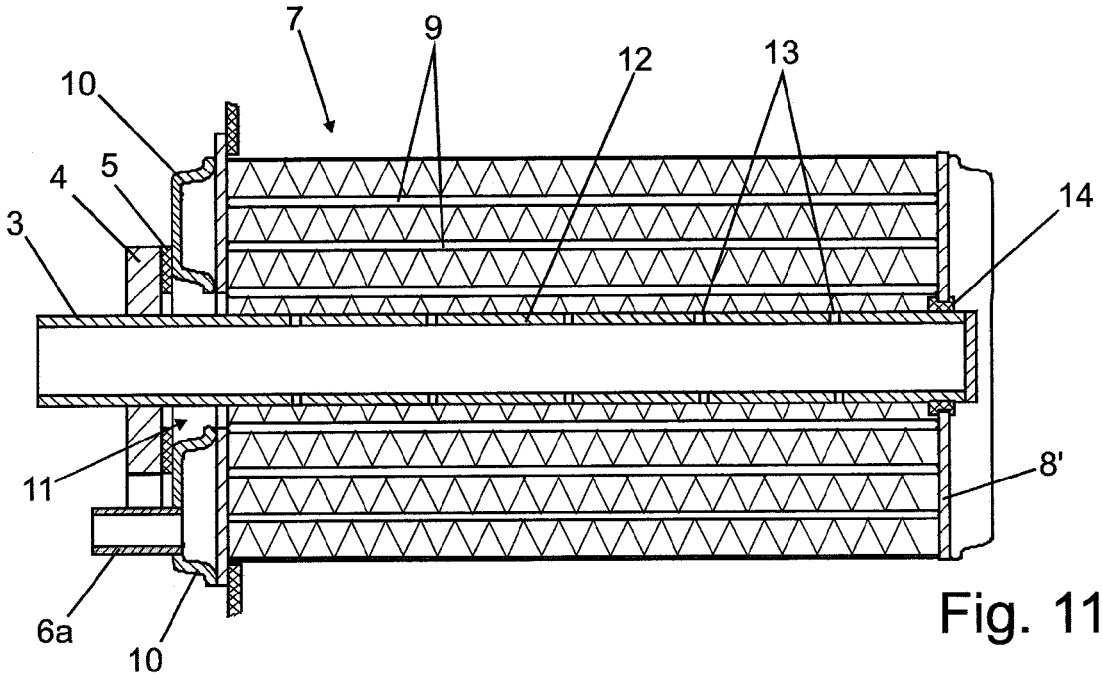
FIG. 11 shows a sectional view through a seventh embodiment of the invention.

Seventh Embodiment (FIG. 11)

FIG. 11 shows an embodiment similar to the example from FIG. 9, FIG. 10, with the exhaust gas pipe ending directly into a charge air cooler. A flange 4 of the exhaust gas pipe 3 sits on a header tank 10 in a sealing manner, the header tank 10 surrounding a recess 11 which is passed through by the exhaust gas pipe and which is not passed by the coolant. In this embodiment, the header tank as a whole is defined as a coolant channel for the exhaust gas pipe.

Furthermore, the exhaust gas pipe 3, which protrudes into the charge air cooler 7, is formed as a tube section 12 with a plurality of radially oriented outlet openings 13 for the exhaust gas. Thereby, the exhaust gas is distributed on several small partial streams, hence avoiding a local overheating of parts of the charge air cooler 7. Basically, such tube section 12 may, even under retaining the mentioned advantages, end into a simple channel 1; see for example the first embodiment.

In the present case, the tube section 12 is closed at its end, the tube section being accommodated with its closed end in a sealing 14 in an aperture of a bottom 8', which is positioned opposite to the bottom 8 of the insertion side. According to the respective construction, the tube section may, of course, alternatively protrude freely into the charge air cooler 7.

Figure 12:
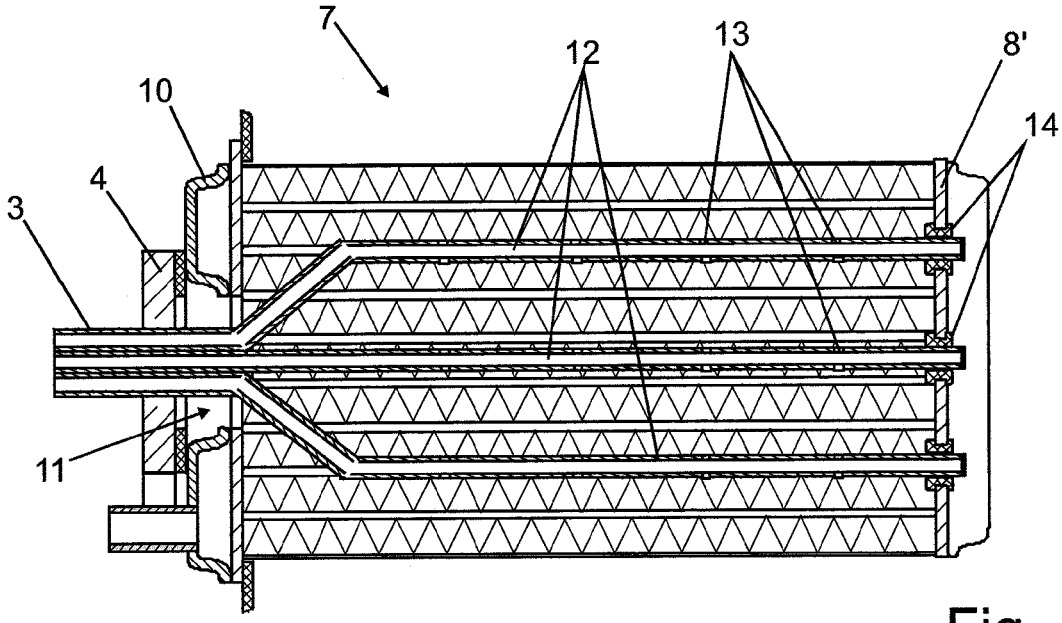
FIG. 12 shows a sectional view through an eighth embodiment of the invention.

Eighth Embodiment (FIG. 12)

As distinguished from the seventh embodiment, in the case of the eighth embodiment a branching of the exhaust gas tube into several, presently three, tube sections 12 is given, a still further distribution of the effusion of the exhaust gas being achieved. The branching is placed inside the charge air cooler behind the recess 11 and/or the bottom 8 of the insertion side.

Figure 13:
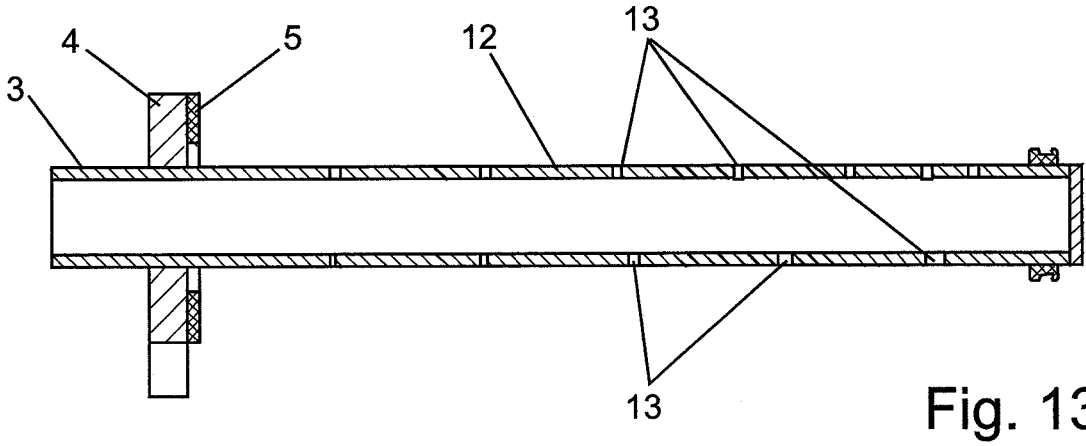
FIG. 13 shows a sectional view through a ninth embodiment of the invention.

Ninth Embodiment (FIG. 13)

This embodiment refers to a development of an exhaust gas pipe 3 with a tube section 12 like in the example of FIG. 11. Presently, the outlet openings 13 are provided over the extension of the tube section 12 with increasing spatial density (see top cutting edge of the tube section 12) and/or with increasing sectional area in the case of a constant distance (see bottom cutting edge of the tube section 12). In each case it is achieved that a hydraulic outflow width per length unit of the tube section 12 is increasing in the flow direction, hence the pressure loss caused by the outflow being compensated. Altogether, a more homogenous mass flow of the effusing exhaust gas over the length of the tube section 12 is achieved.

Figure 14:
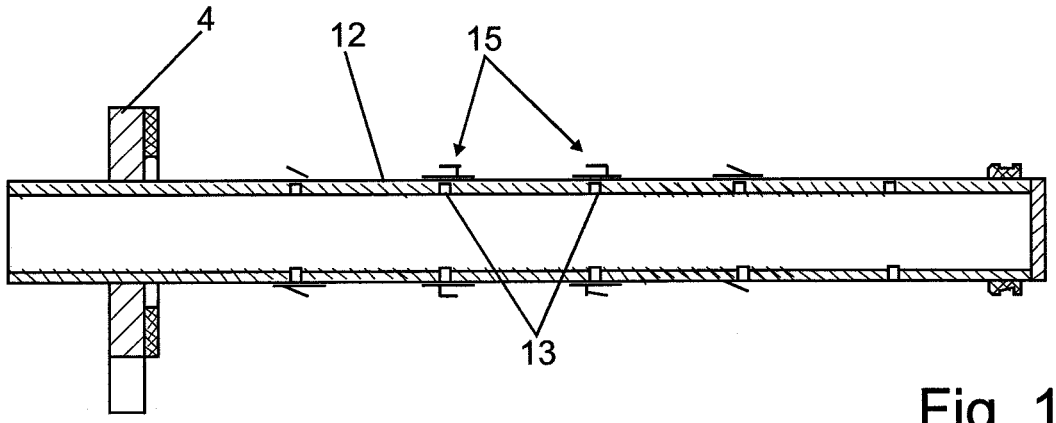
FIG. 14 shows a sectional view through a tenth embodiment of the invention.
Figure 15:
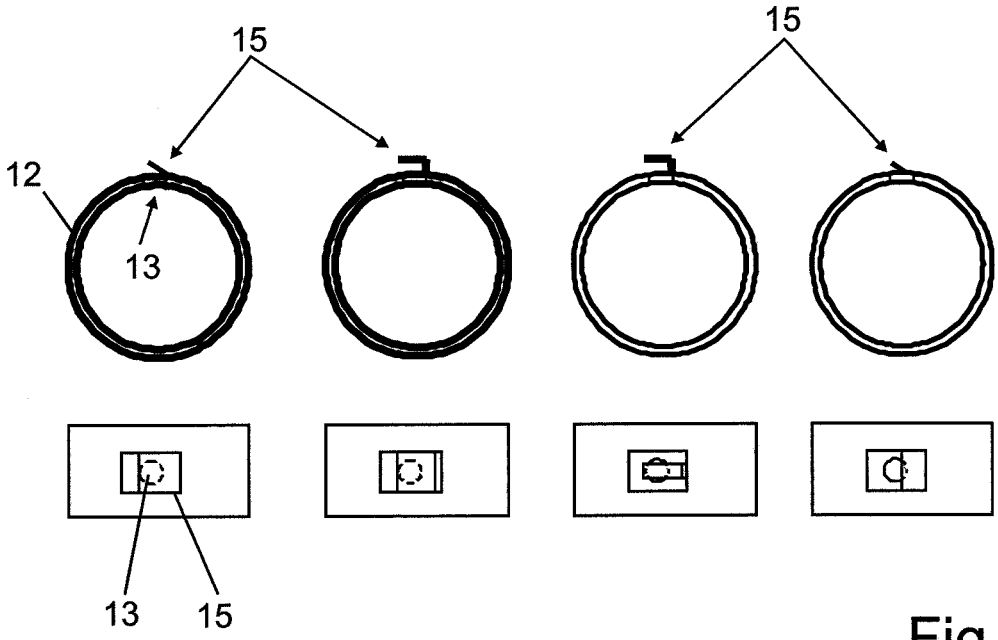
FIG. 15 shows four sectional views and partial plain views in several plains of the embodiment of FIG. 14.

Tenth Embodiment (FIG. 14, FIG. 15)

As a further possibility to influence the exhaust gas effusion, in the example of FIG. 14 flow obstacles 15 are arranged over at least some of the outlet openings 13. The flow obstacles 15 are presently formed as slide-on sheet metal rings, which, at the positions of the overlay with the outlet openings 13, comprise flaps which are of defined dimension and set up. Depending on the position at the tube section 12, the flaps or flow obstacles are differently shaped and/or set up. For reasons of clarity, FIG. 15 displays four sectional views through the four sheet metal rings shown in FIG. 14, as well as a respective partial plain view on the flaps.

Figure 16:
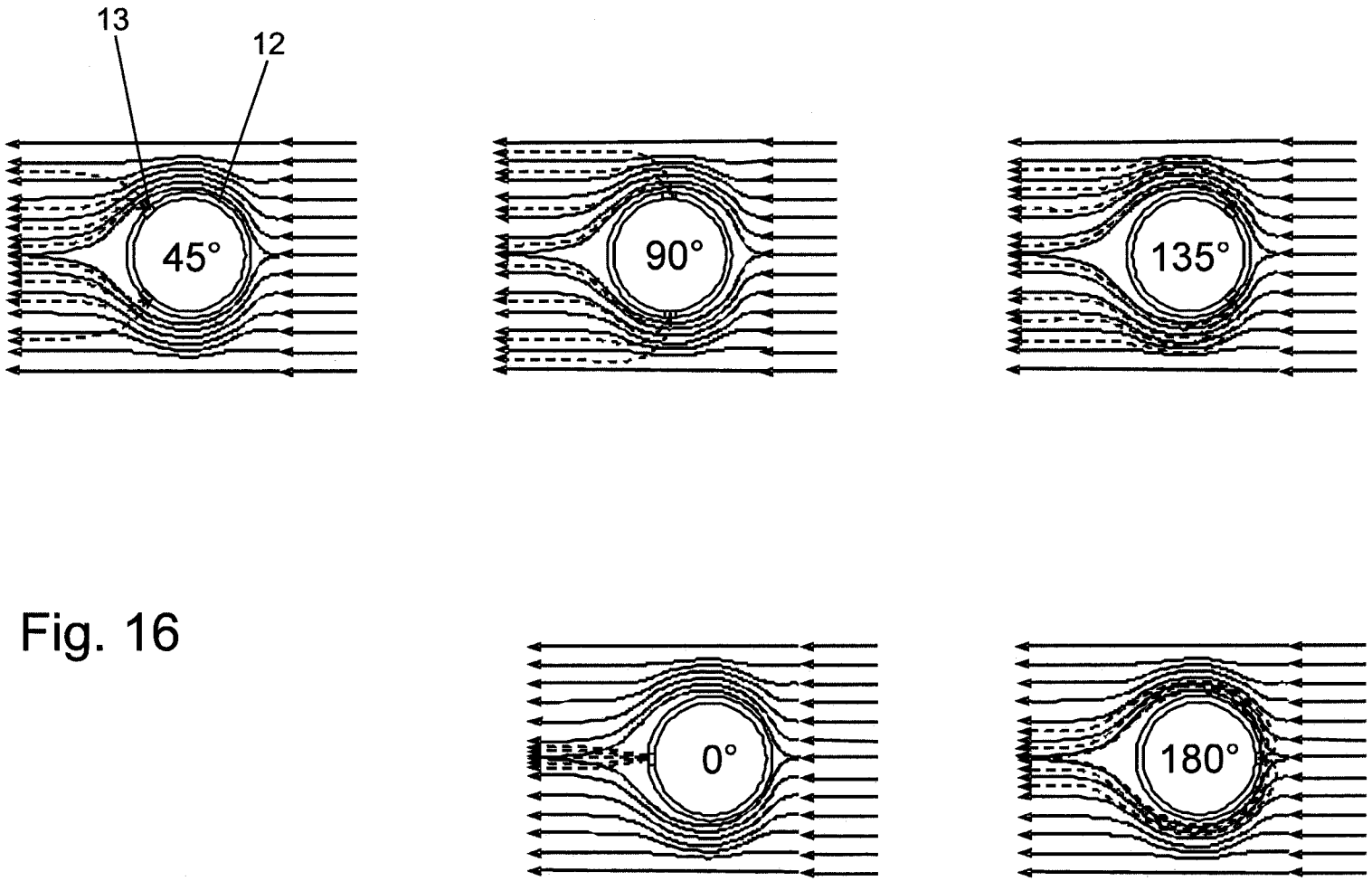
FIG. 16 shows different outlet angles of an eleventh embodiment of the invention.

Eleventh Embodiment of the Invention (FIG. 16)

In FIG. 16, streams of charged air (solid lines) as well as exhaust gas (dashed lines) which effuses from a tube section 12 are displayed, the outlet openings being aligned, in each case, in different angles with respect to the symmetry plane or main flow direction of the charged air.

It becomes obvious that in the case of too small angles (e.g. 0°) as well as too big angles (e.g. 180°), a relatively compact exhaust gas plume is formed. This means a relatively poor mixing and the danger of a local overheating of parts of the air channel and/or charge air cooler.

Hence, an angle of the outlet openings 13 with respect to the geometrical flow direction of the charged air (i.e. horizontally from right to left in the drawings) is selected between 45° and 135°, preferredly between 90° and 135°.

It is to be understood that any individual features of the embodiments described above can be combined in a reasonable manner according to the respective demands. In particular the provision of a tube section 12 with a number of outlet openings 13 and its respective detailed embodiments can be combined with any of the other embodiments. In a possible embodiment of the invention it is not necessarily provided that the exhaust gas pipe 3 with the tube section 12 is cooled by means of a coolant. A more homogenous distribution of the hot exhaust gas over a larger space area can be achieved by means of the tube section 12 itself, a critical heat exposure of e.g. a channel wall being avoided.

The invention being thus described, it will be obvious that the same may be varied in many ways. Such variations are not to be regarded as a departure from the spirit and scope of the invention, and all such modifications as would be obvious to one skilled in the art are to be included within the scope of the following claims. For example, one skilled in the art can combine any of the features illustrated with one another that are described in the specification and/or in the drawings.

What is claimed is:

1. A device for exhaust gas recirculation for a combustion engine, the device comprising:

an exhaust gas pipe configured to conduct exhaust gas;

a channel configured to conduct air to the combustion engine, the exhaust gas pipe extending into the channel;

an assembly member that is connectable to the channel, the assembly member having a central opening, the exhaust gas pipe inserted into the central opening so as to pass through the central opening; and the exhaust gas pipe having a flange that is connectable to the assembly member, wherein the exhaust gas pipe, in an area of insertion in the channel, is in thermal exchange with a coolant from a coolant circuit, wherein the coolant passes through a coolant channel of the coolant circuit, the coolant channel being provided at the assembly member, and wherein the flange is provided on a side of the assembly member that is opposite to a side at which the coolant channel is provided.

2. The device as claimed in claim 1, wherein a seal is arranged between the flange and the assembly member.

3. The device as claimed in claim 1, wherein the coolant channel is formed as a tube that is connectable to the assembly member.

4. The device as claimed in claim 1, wherein the coolant channel is formed as a sheet metal part, either one-piece or multipart, which is connectable with the assembly member by bonding.

5. The device as claimed in claim 1, wherein an insertion area of the exhaust gas pipe is provided at a charge air cooler that is passed through by the coolant.

6. The device as claimed in claim 5, wherein the insertion area is provided at a coolant-sided header member of the charge air cooler.

7. The device as claimed in claim 1, wherein the exhaust gas pipe enters into the channel upstream of a charge air cooler.

8. The device as claimed in claim 1, wherein the channel is made of plastic at least in a region of insertion of the exhaust gas pipe.

9. A device for exhaust gas recirculation for a combustion engine, the device comprising:

an exhaust gas pipe configured to conduct exhaust gas; and a channel configured to conduct air to the combustion engine, the exhaust gas pipe terminating in the channel, wherein the exhaust gas pipe, in a region of insertion into the channel, is designed as at least one tube section, the tube section having a plurality of outlet openings for the exhaust gas along the tube section, and wherein the at least one tube section is surrounded by a charge air cooler.

10. The device as claimed in claim 9, wherein the exhaust gas pipe branches into a plurality of tube sections in the region of its insertion.

11. The device as claimed in claim 9, wherein the outlet openings are, with respect to their number and/or size, distributed alongside the tube section such that a hydraulic outflow width per length unit of the tube section increases in a flow direction of the exhaust gas.

12. The device as claimed in claim 9, wherein flow obstacles are arranged at at least some of the outlet openings.

13. The device as claimed in claim 9, wherein the outlet openings are aligned at an outlet angle of between 45° and 135° or between 90° and 135° with respect to a main flow direction of the air in the channel.

14. The device as claimed in claim 1, wherein the assembly member is formed of metal.

15. The device as claimed in claim 3, wherein the coolant channel is connected to the assembly member by bonding.

16. The device as claimed in claim 1, wherein the coolant channel is arranged entirely at the assembly member.

17. The device as claimed in claim 1, wherein no seal is provided between the coolant channel and the exhaust pipe.

18. The device as claimed in claim 1, wherein the exhaust gas pipe extending into the channel has a tube section having a plurality of outlet openings arranged thereon such that the exhaust gas is configured to flow through the outlet openings into the channel.

* * * * *